US012060200B2

(12) United States Patent
Buzzi

(10) Patent No.: US 12,060,200 B2
(45) Date of Patent: Aug. 13, 2024

(54) CAP FOR A SPOUT OF A FLEXIBLE THIN-WALLED PACKAGING

(71) Applicant: GUALA PACK S.P.A., Castellazzo Bormida (IT)

(72) Inventor: Alberto Buzzi, Castellazzo Bormida (IT)

(73) Assignee: GUALA PACK S.P.A., Castellazzo Bormida (Alessandria) (IT)

( * ) Notice: Subject to any disclaimer, the term of this patent is extended or adjusted under 35 U.S.C. 154(b) by 393 days.

(21) Appl. No.: 17/428,376

(22) PCT Filed: Feb. 5, 2020

(86) PCT No.: PCT/IB2020/050912
§ 371 (c)(1),
(2) Date: Aug. 4, 2021

(87) PCT Pub. No.: WO2020/165695
PCT Pub. Date: Aug. 20, 2020

(65) Prior Publication Data

US 2022/0112008 A1 Apr. 14, 2022

(30) Foreign Application Priority Data

Feb. 13, 2019 (IT) ..... 102019000002103

(51) Int. Cl.
*B65D 47/12* (2006.01)
*B65D 75/58* (2006.01)

(52) U.S. Cl.
CPC ..... *B65D 47/123* (2013.01); *B65D 75/5883* (2013.01); *B65D 2575/586* (2013.01)

(58) Field of Classification Search
CPC ..... B65D 47/123; B65D 75/5883; B65D 2575/586
See application file for complete search history.

(56) References Cited

U.S. PATENT DOCUMENTS 6,536,618 B1 * 3/2003 Hwang ..... B65D 39/12 215/361
8,443,999 B1 * 5/2013 Reinders ..... B65D 41/3409 215/253

(Continued)

FOREIGN PATENT DOCUMENTS

DE 102014016178 A1 5/2016
FR 2933385 A1 1/2010

(Continued)

OTHER PUBLICATIONS

International Search Report and Written Opinion for International Patent Application No. PCT/IB2020/050912, mailed Apr. 22, 2020, 10 pages.

(Continued)

*Primary Examiner* — J C Jacyna
(74) *Attorney, Agent, or Firm* — Armstrong Teasdale LLP

(57) ABSTRACT

A cap for a spout of a flexible thin-walled packaging is provided. The cap has a closure body having an annular closure wall extending along a main axis between a lower end and an upper end. An extension ending with a base is placed at a predefined height below the lower end of the annular closure wall. A scraper element is arranged along the extension to remove any residue of product in the spout.

7 Claims, 7 Drawing Sheets

(56) References Cited

U.S. PATENT DOCUMENTS

| | | | | |
|---|---|---|---|---|
| 8,528,757 | B2 * | 9/2013 | Bisio | B65D 75/5883 215/258 |
| 2012/0211460 | A1 * | 8/2012 | Tamarindo | B65D 41/0485 215/329 |
| 2015/0144632 | A1 * | 5/2015 | Tamarindo | B65D 51/24 220/265 |
| 2016/0068316 | A1 | 3/2016 | Wolff et al. | |
| 2017/0275064 | A1 | 9/2017 | Roosendaal et al. | |
| 2020/0361664 | A1 * | 11/2020 | Ekkert | B65D 41/04 |
| 2020/0391908 | A1 * | 12/2020 | Klatt | B65D 39/086 |

FOREIGN PATENT DOCUMENTS

| | | | | |
|---|---|---|---|---|
| JP | 200490964 | * | 3/2004 | B65D 75/5883 |
| JP | 2004090964 | A | 3/2004 | |
| WO | 2008050361 | A1 | 5/2008 | |
| WO | 2014187520 | A1 | 11/2014 | |
| WO | 2015125071 | A1 | 8/2015 | |
| WO | 2016140668 | A1 | 9/2016 | |
| WO | 2018020365 | A1 | 2/2018 | |

OTHER PUBLICATIONS

International Preliminary Report on Patentability for International Patent Application No. PCT/IB2020/050912, mailed Jun. 14, 2021, 10 pages.

Partial English translation of Italian Search Report for Italian Patent Application No. 102019000002103, mailed Nov. 15, 2019, 9 pages.

* cited by examiner

CAP FOR A SPOUT OF A FLEXIBLE THIN-WALLED PACKAGING

CROSS-REFERENCE TO RELATED APPLICATIONS

This application is a National Stage Application of International Patent Application No. PCT/IB2020/050912, having an International Filing Date of Feb. 5, 2020, which claims the benefit of priority to Italian Patent Application No. 102019000002103, filed Feb. 13, 2019, the entire contents of which are hereby incorporated by reference herein.

FIELD OF THE INVENTION

The subject-matter of the present invention is a cap for a spout of a flexible thin-walled packaging, usually called a "pouch".

BACKGROUND OF THE INVENTION

As is well known, pouches equipped with a spout (known as 'spouted pouches') have recently experienced a widespread growth, due to their versatility for the containment of liquids of different kinds and for the convenience of use, especially by children.

These packages are now used for the containment of fruit juices, fruit pure, yogurt, and other similar products, i.e. products that are easily perishable when in contact with the atmosphere.

As a result, one of the problems most encountered in the sector is that of limiting the contact between the product contained in the pouch and the atmosphere in order to extend the life of the product and thus also the shelf-life of the pouch.

The packaging basically consists of three components: a thin-walled flexible pouch, a spout welded to the pouch and a cap that closes the spout. In general, oxygen from the atmosphere could pass inside the pouch through one of these components.

The effect of the cap is negligible, while the thin walls that make up the pouch are made of a monolayer or multi-layer film, capable of creating a barrier to the passage of oxygen.

For the spout, various solutions have been proposed, such as the use of a layer that is impermeable to oxygen embedded in the wall of the spout. An example of such a solution is illustrated in the International Application WO-A1-2015/125071, in the name of the Applicant.

A particularly effective solution, on the other hand, provides for the cap to be fitted with an elongated tubular element closed at the lower end, which penetrates into the tube of the spout and closes the mouth at the level of the weld with the pouch. As a result, the oxygen passing through the walls of the tube does not come into contact with the product contained in the pouch.

This solution is illustrated, for example, in documents JP-A-2004-090964 and WO-A1-2014/187520.

The Applicant, however, has found that, despite the use of such caps with elongated tubular element, traces of the product are still deteriorating due to oxidation, in particular in the case of pre-made pouches, i.e. pouches that are filled with the product, usually by a party known as a co-packer, when already provided with the spout; after filling, the cap is applied.

SUMMARY OF THE INVENTION

The object of the present invention is to construct a cap that satisfies the requirements of the sector and at the same time overcomes the drawbacks mentioned above.

This object is achieved by a cap for a spout as described and claimed herein.

BRIEF DESCRIPTION OF THE DRAWINGS

The features and advantages of the cap according to the present invention will be apparent from the description given below, provided by way of non-limiting example, in accordance with the accompanying figures, wherein.

DETAILED DESCRIPTION

Figure 1A:
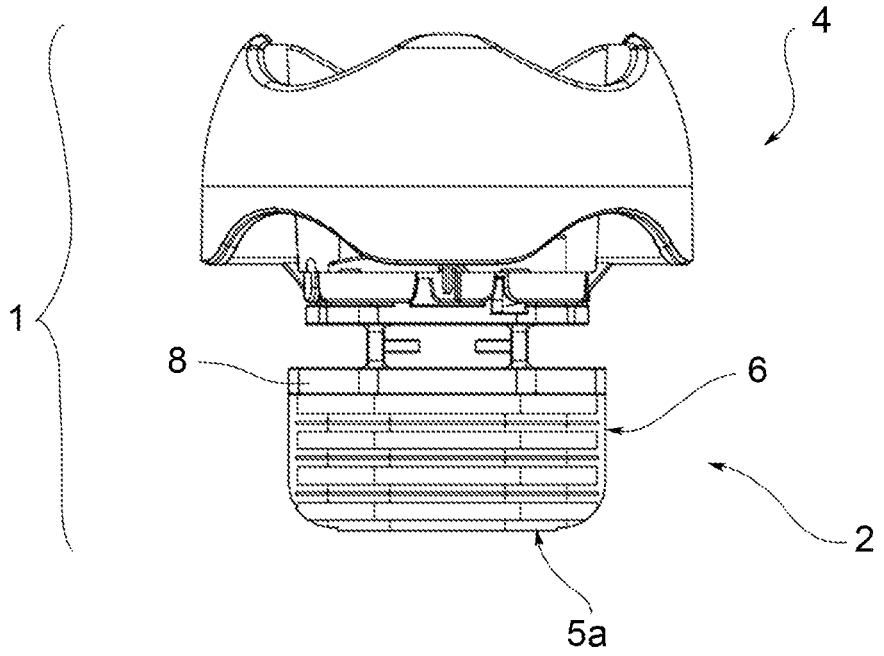
FIGS. 1*a* and 1*b* show respectively a front view and a side view of an assembly according to the present invention, consisting of a spout and a cap.
Figure 1B:
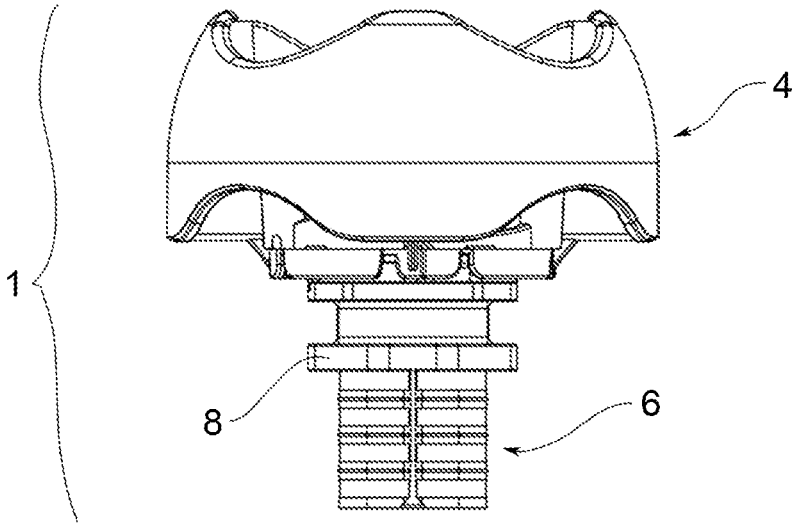

At 1 is collectively indicated a cap-spout assembly consisting of a spout 2 suitable to be sealingly connected to a flexible thin-walled pouch, typically by welding, and a cap 4 for the closure of the spout.

The spout 2 comprises a cylindrical tube 5 extending along a main axis X between a lower end 5*a*, where the inlet mouth of the product into the tube is arranged, and an upper end 5*b*, where the outlet mouth of the product is arranged.

At the lower end 5*a*, the spout 2 comprises a connection region 6 extending radially from the tube 5; said connection region is usually called the "welding boat" and is intended for welding the spout with the thin walls of the pouch.

The spout 2 further comprises a main plate 8, protruding externally from the tube 5, which delimits the connection region 6 at the top.

Figures 2A, 2B, 2C:
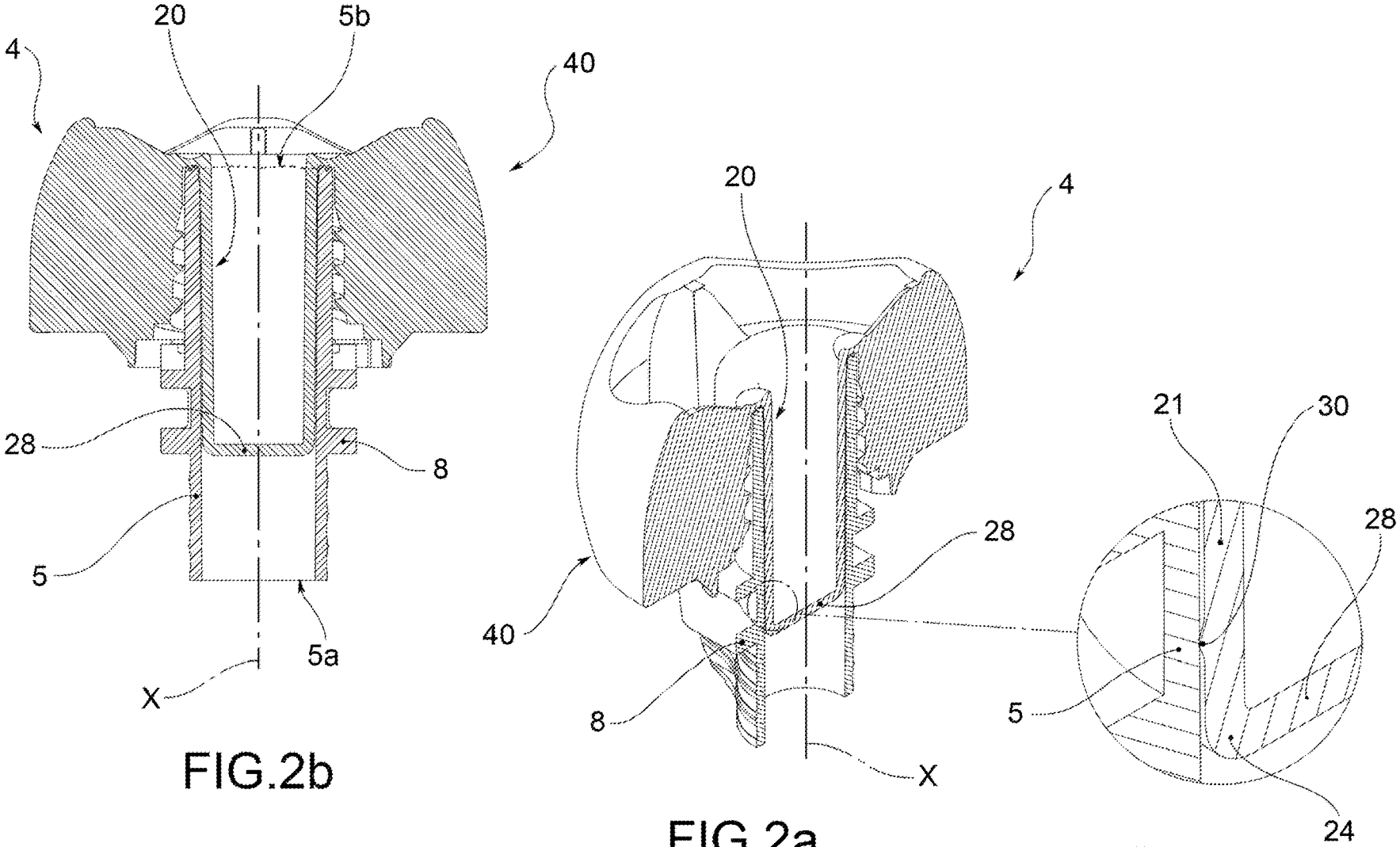
FIGS. 2*a* and 2*b* represent views in cross-section of the assembly in FIGS. 1*a* and 1*b*, according to a first embodiment of the invention.
FIG. 2*c* depicts an enlargement of a detail of FIG. 2*b;*
Figure 3A:
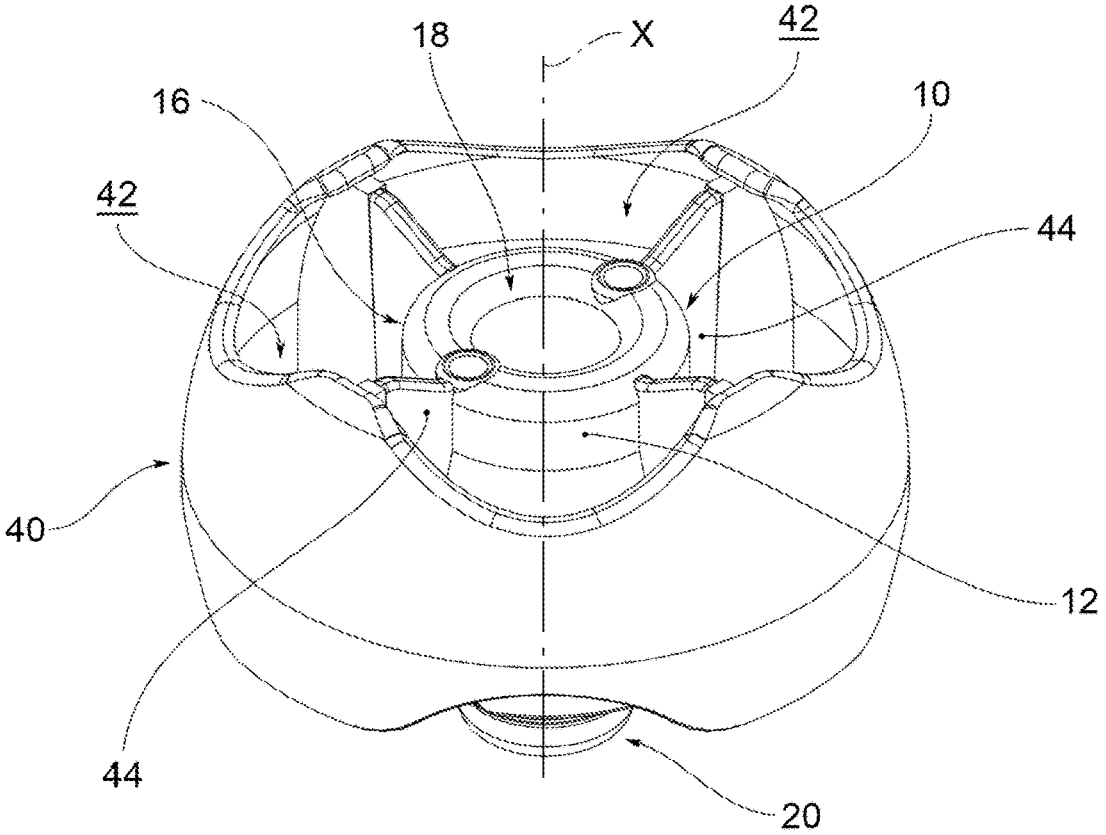
FIGS. 3*a* and 3*b* illustrate the cap of the assembly in FIGS. 2*a* and 2*b;*
Figure 3B:
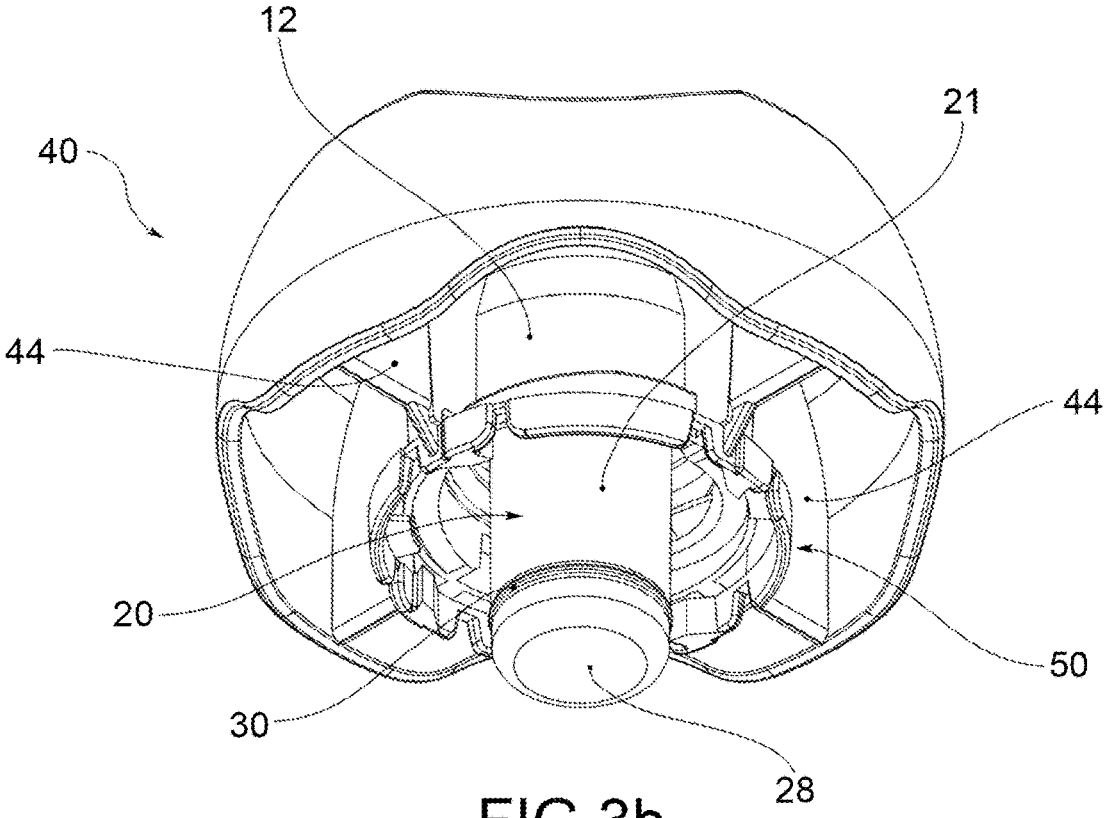
Figure 3C:
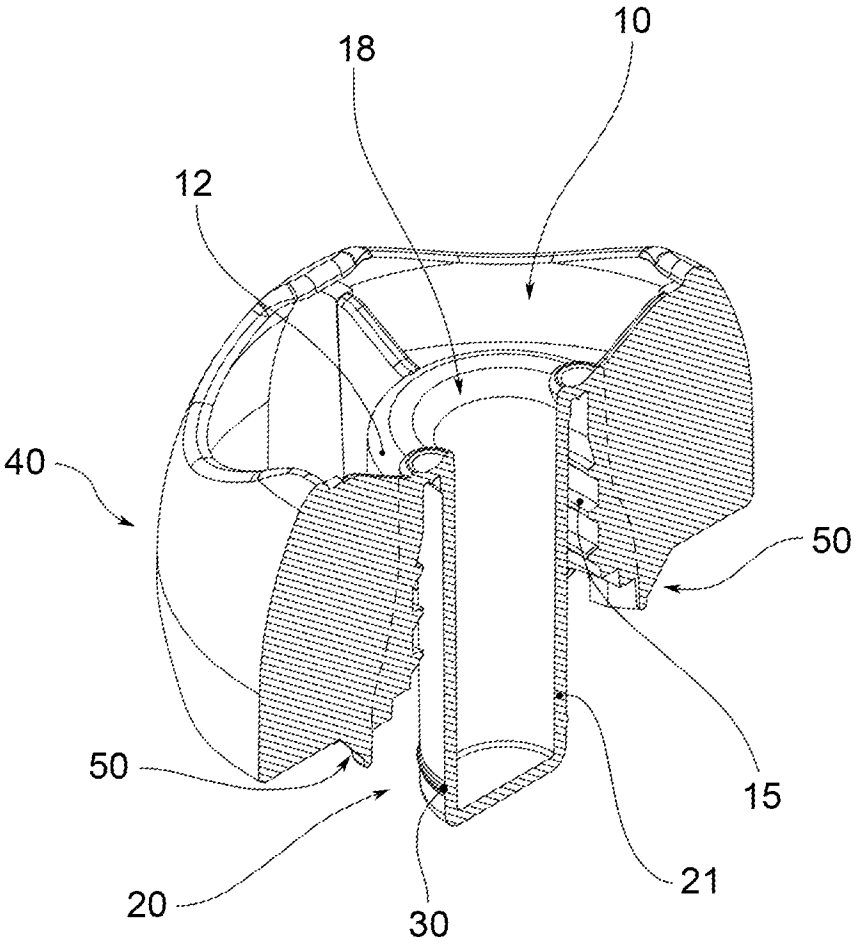
FIGS. 3*c* and 3*d* show views in cross-section of the cap in FIGS. 3*a* and 3*b;*
Figure 3D:
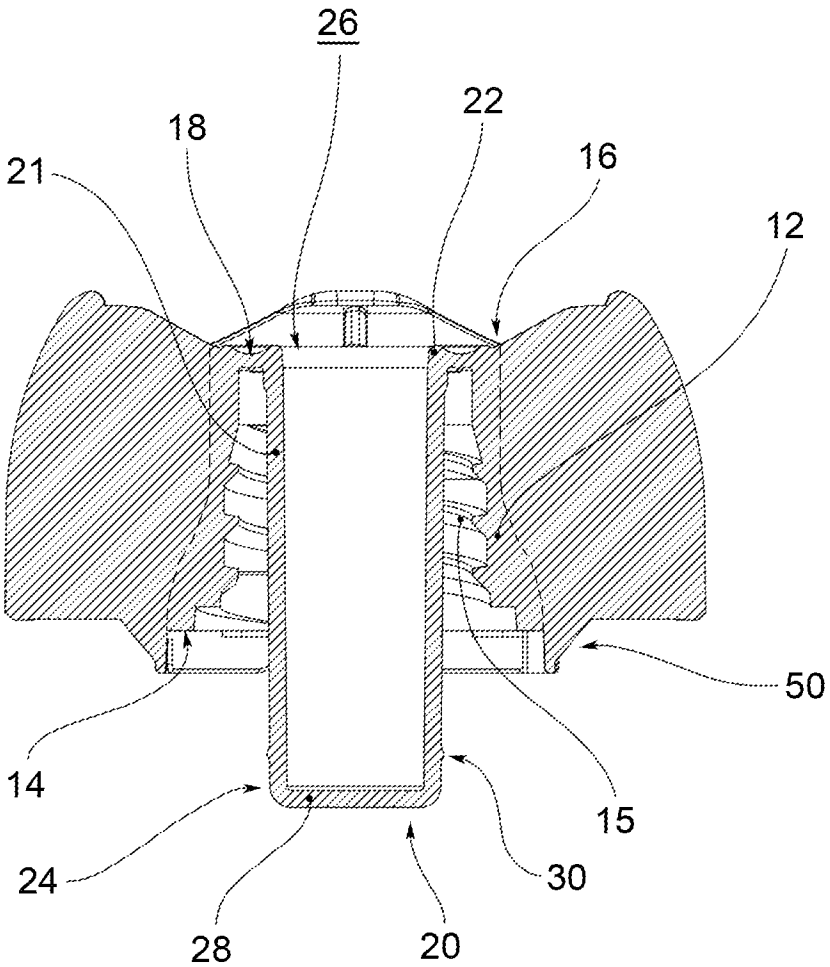

According to a first embodiment of the invention (FIGS. 2*a* to 3*d*), the cap 4 comprises a closure body 10 comprising an annular closure wall 12, coaxial to the tube 5 of the spout. The closure wall 12 extends along said main axis X between a lower end 14 and an upper end 16, where a closure portion 18 of the closure body 10 is placed.

Internally, the closure wall 12 has a thread 15 for screwing the closure body 10 to the tube 5.

The cap 4 further comprises a extension 20 coaxial to the main axis X, having mainly axial extension, suitable to close the tube 5 to prevent the product from escaping.

The extension 20 comprises an annular side wall 21 extending axially, preferably having externally a frustoconical shape, so as to close the tube 5 of the spout 2.

Said side wall 21 extends from the closure wall 12, for example from an upper end 22, placed at the upper end of the closure wall 12, to a lower end 24, placed axially below the lower end 14 of the closure wall 12.

Preferably, said extension 20 is tubular and has an opening 26 at the upper end 22, while it provides a base 28 that closes the lower end 24 of the side wall 21.

Said extension 20 further provides for an elastically yielding annular ridge 30 protruding radially from the outer surface of the side wall 21, placed, for example, near the lower end 24 of said side wall 21.

When the cap 4 is applied to the spout 2, the extension 20 enters the tube 5 through the outlet mouth and in the final screwed on configuration, the base 28 of said extension 20 is located at a height comprised in the connection region 6 or at the beginning thereof, for example at the height of the main plate 8.

As a result, the oxygen of the atmosphere passing through the wall of the tube above the connection region does not enter the pouch and therefore does not come into contact with the product contained therein.

Moreover, while the cap 4 is applied to the spout, the ridge 30 is deformed elastically and in contact with the inner surface of the tube, and when pressure is exerted thereon, cleans it of product residues which, during the filling of the packaging (already fitted with the spout, according to the pre-made technology), may have been deposited on the surface of the tube.

In other words, the ridge 30 works as a scraping element that removes product residues from the surface on which it passes.

The cap 4 further comprises, preferably, a grip portion 40, preferably coaxial to the closure wall 12, circumferentially continuous or continuous in sections.

Said grip portion 40 is radially spaced from the closure wall 12, thus forming therewith anti-choke passages 42.

Preferably, moreover, the cap 4 comprises a plurality of fins 44, typically lying on imaginary planes containing said main axis X, which make the grip portion 40 integral with the closure body 10.

Preferably, moreover, the cap 4 comprises a breakable guarantee seal 50, arranged at the lower end 14 of the closure wall 12, below the same.

The guarantee seal 50 engages with a portion of the spout and tears when the cap is opened for the first time.

An example of a guarantee seal is described in the International Application WO-A1-2008/050361 in the name of the Applicant, the teaching on the structural and functional features of said seal of which is explicitly incorporated herein.

Figure 4C:
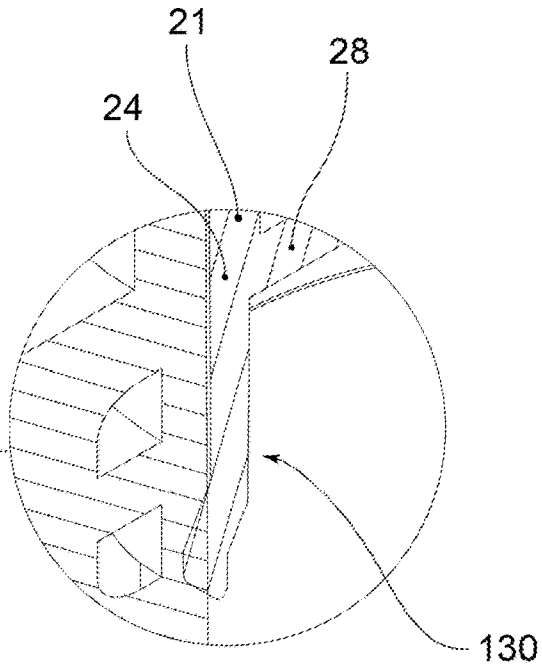
FIG. 4*c* depicts an enlargement of a detail of FIG. 4*b;*
Figure 4A:
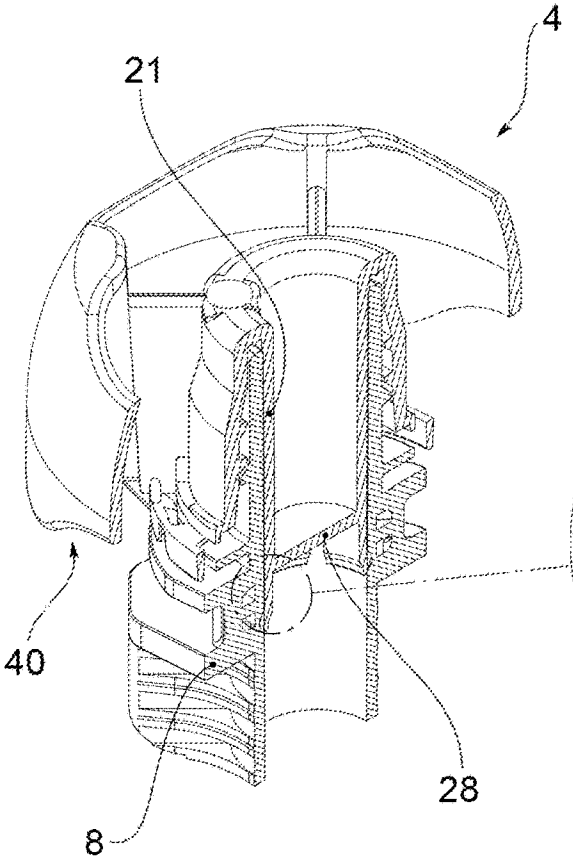
FIGS. 4*a* and 4*b* represent views in cross-section of the assembly according to the invention, in accordance with a further embodiment.
Figure 4B:
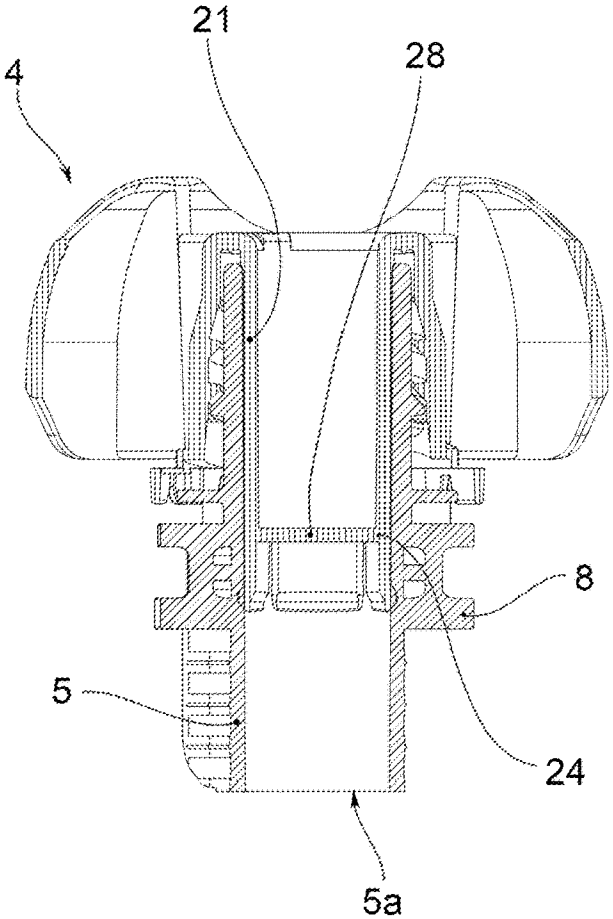
Figure 5A:
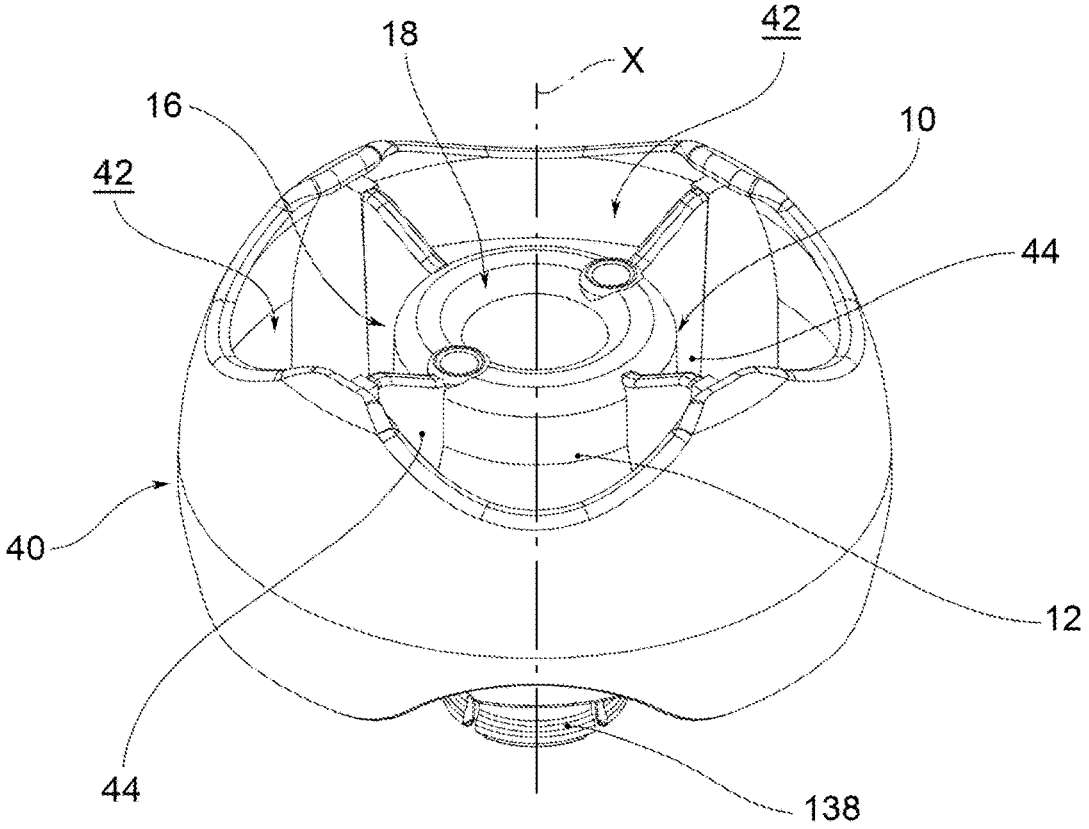
FIGS. 5*a* and 5*b* illustrate the cap of the assembly in FIGS. 4*a* and 4*b;*
Figure 5B:
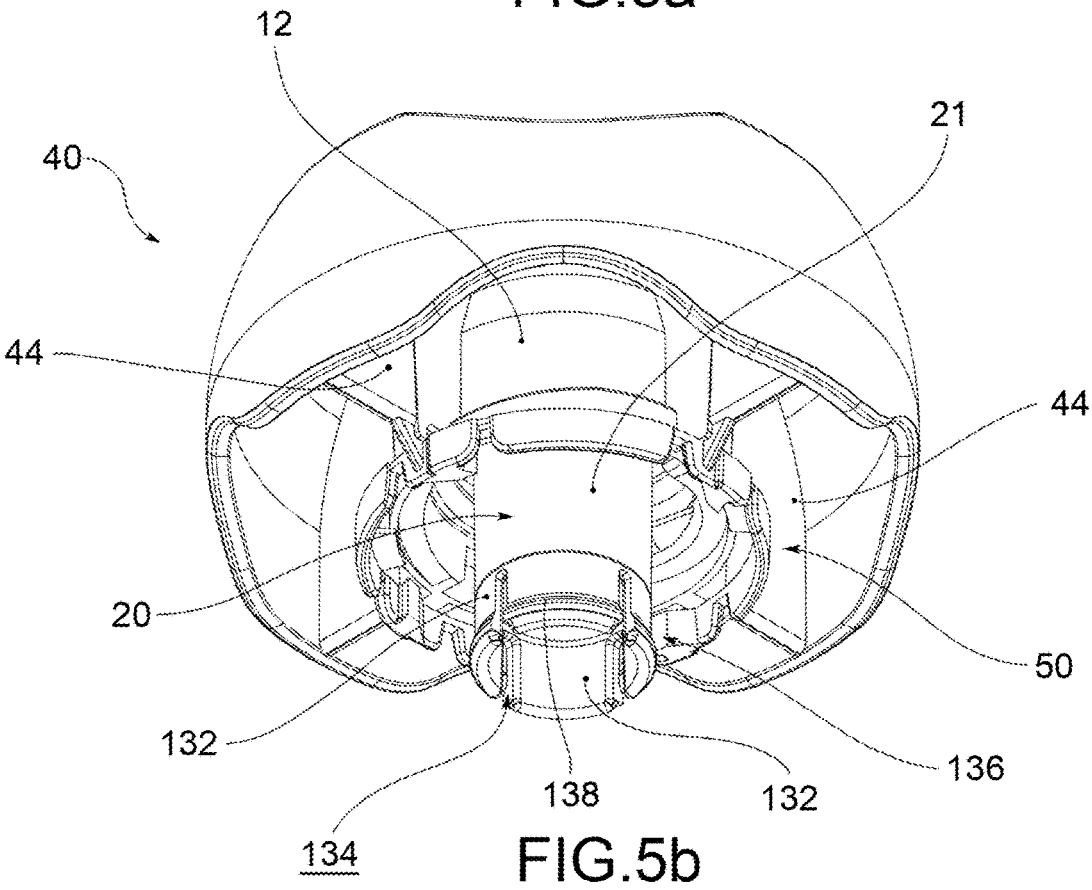
Figure 5D:
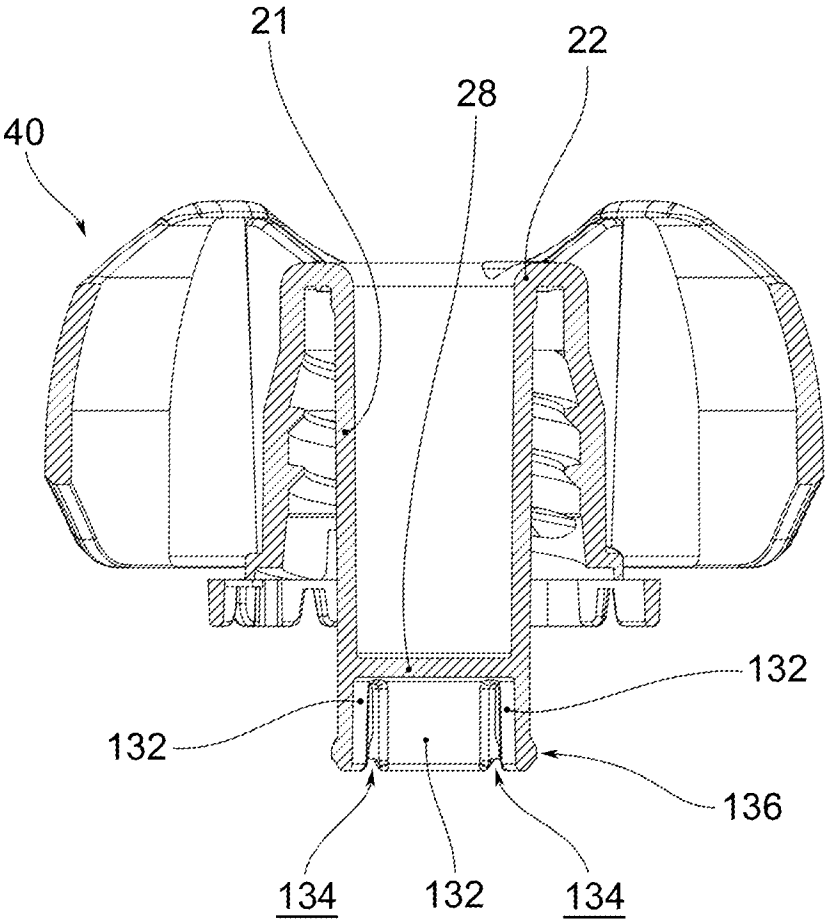
FIGS. 5*c* and 5*d* show views in cross-section of the cap in FIGS. 4*a* and 4*b*.
Figure 5C:
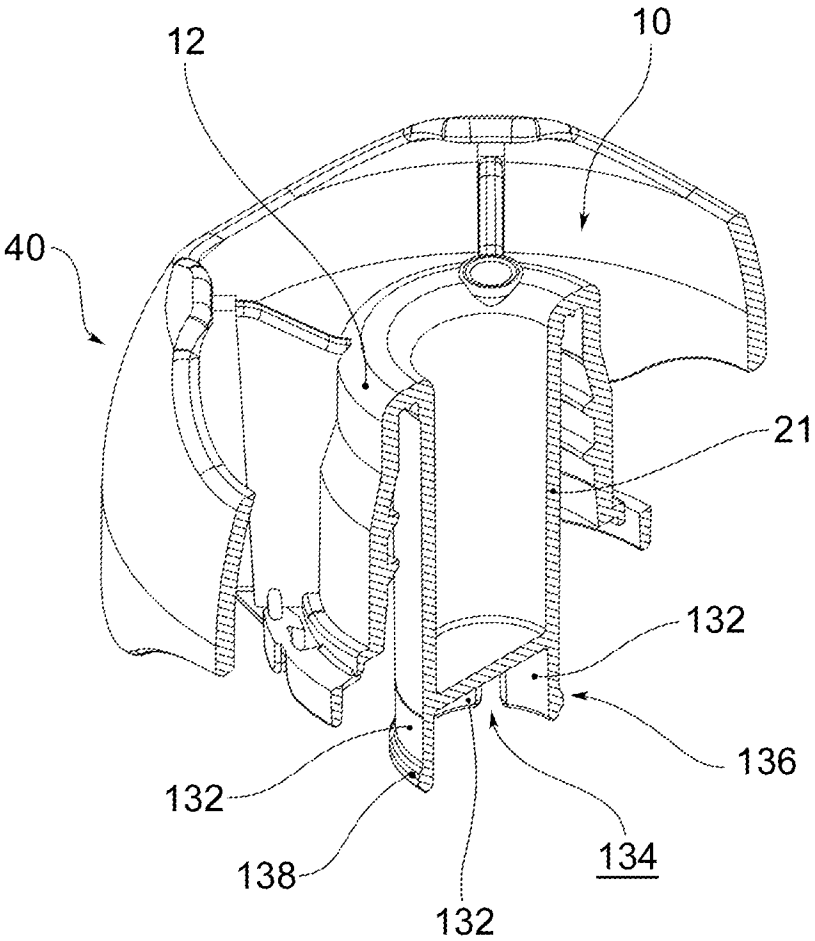

FIGS. 4*a* to 5*d* represent a further embodiment of the invention; in these figures the same numerical references used in the previous figures are used for the corresponding elements.

According to this further embodiment of the invention, the extension 20 comprises an elastically yielding annular tang 130, circumferentially continuous or continuous in sections, which extends axially from the lower end 24 of the side wall 21.

The tang 130 is configured to come into pressure contact with the inner surface of the side wall 21 of the tube 5, so as to sweep away any product residue present on said surface.

Preferably, said tang 130 consists of a plurality of petals 132 in circumferential succession, separated circumferentially by axial slits 134 that facilitate the elastic deformation of the tang 130 when it penetrates the tube 5 of the spout.

Preferably, moreover, the tang 130 is provided with a protrusion 136 protruding outwards radially, preferably divided into sections of protrusion 138, one for each petal.

As a result, in the non-deformed configuration, the diameter of the tang 130 is considerably larger than the inner diameter of the tube 5 of the spout, but the presence of the configuration with the petals separated allows an elastic contraction that allows the tang to penetrate into the tube and advance along it, sweeping away product residues.

The tang 130 therefore also acts as a scraping element for product residues.

--o--

Preferably, moreover, the cap according to the present invention is made of a single piece of plastic material, e.g. polyethylene (PE) or polypropylene (PP), by injection molding.

Innovatively, the cap according to the present invention meets the needs of the sector and at the same time overcomes the drawbacks mentioned above, since it allows the elimination of product residues from the internal surface of the tube, preventing them from giving rise to bacterial outbreaks.

It is clear that a person skilled in the art, in order to meet specific needs, could make changes to the cap described above.

For example, according to a variant embodiment, the guarantee seal is obtained by using the cap described above as an outer cap and providing for an additional, separate closure body that may be housed in the outer cap, implementing the system described in International Application WO-A1-2018/020365 in the name of the Applicant.

Such variants are also contained within the scope of protection as defined by the following claims.

What is claimed is:

1. A cap for a spout of a flexible thin-walled packaging, the cap comprising:

a closure body suitable for closing the spout, the closure body comprising an annular closure wall extending along a main axis between a lower end and an upper end;

an extension comprising an annular side wall extending from the annular closure wall to a lower end, coaxially to the annular closure wall, and a base closing the annular side wall at the lower end, wherein the base is placed at a predefined height below the lower end of the annular closure wall, said extension being tubular and comprising an opening at an upper end thereby forming an internal cavity; and a scraper element located along the annular side wall of the extension, elastically yielding to advance at pressure contact on a side surface of a tube of the spout and to remove any product residues present in the spout;

wherein said scraper element is an annular ridge, protruding radially externally from the annular side wall;

wherein said ridge is arranged near the lower end of the annular side wall, and wherein said ridge extends around a circumference of the annular side wall at an axial location of the annular side wall that surrounds the internal cavity.

2. The cap of claim 1, comprising a grip portion, coaxial to the annular closure wall, circumferentially continuous or continuous in sections.

3. The cap of claim 2, wherein the grip portion is radially spaced from the annular closure wall, forming therewith anti-suffocation passages.

4. The cap of claim 2, further comprising a plurality of fins making the grip portion integral with the closure body.

5. The cap of claim 1, further comprising a breakable guarantee seal, arranged at the lower end of the annular closure wall, below the annular closure wall.

6. The cap of claim 1, made in a single piece of plastic material.

7. A cap-spout assembly for a flexible thin-walled packaging, the cap-spout assembly comprising:

a spout comprising a connection region for welding with thin walls of the packaging;

a cap comprising:

a closure body suitable for closing the spout, the closure body comprising an annular closure wall extending along a main axis between a lower end and an upper end;

an extension comprising an annular side wall extending from the annular closure wall to a lower end, coaxially to the annular closure wall, and a base closing the annular side wall at the lower end, wherein the base is placed at a predefined height below the lower end of the annular closure wall, said extension being tubular and comprising an opening at an upper end thereby forming an internal cavity; and a scraper element located along the annular side wall of the extension, elastically yielding to advance at pressure contact on a side surface of a tube of the spout and to remove any product residues present in the spout;

wherein said scraper element is an annular ridge, protruding radially externally from the annular side wall;

wherein said ridge is arranged near the lower end of the annular side wall, wherein said ridge extends around a circumference of the annular side wall at an axial location of the annular side wall that surrounds the internal cavity; and wherein the extension is configured so that the base, when the cap is fully applied to the spout, is at a beginning of the connection region or within the connection region.

* * * * *